US006170444B1

(12) United States Patent
Ohlmann

(10) Patent No.: US 6,170,444 B1
(45) Date of Patent: Jan. 9, 2001

(54) AIR AND EXHAUST GAS MANAGEMENT SYSTEM FOR A TWO-CYCLE INTERNAL COMBUSTION ENGINE

(76) Inventor: Hans-Armin Ohlmann, 166 Piper Street, Ayr, Ontario (CA), N0B 1E0

( * ) Notice: Under 35 U.S.C. 154(b), the term of this patent shall be extended for 0 days.

(21) Appl. No.: 09/155,518

(22) PCT Filed: Apr. 11, 1997

(86) PCT No.: PCT/CA97/00246

§ 371 Date: Sep. 25, 1998

§ 102(e) Date: Sep. 25, 1998

(87) PCT Pub. No.: WO97/39230

PCT Pub. Date: Oct. 23, 1997

Related U.S. Application Data

(60) Provisional application No. 60/021,981, filed on Jul. 18, 1996, and provisional application No. 60/015,481, filed on Apr. 12, 1996.

(51) Int. Cl.[7] ..... F02B 25/04

(52) U.S. Cl. ..... 123/69 V; 123/65 A; 123/65 BA; 123/65 P

(58) Field of Search ..... 123/69 V, 65 A, 123/65 BA, 65 E, 65 P, 65 V

(56) References Cited

U.S. PATENT DOCUMENTS

| | | | | |
|---|---|---|---|---|
| 744,881 | * | 11/1903 | Sohnlein | 123/65 A |
| 856,790 | * | 6/1907 | Micklewood et al. | 123/65 A |
| 1,329,811 | * | 2/1920 | Smith | 123/65 BA |
| 1,716,278 | * | 6/1929 | Muller | 123/69 V |
| 2,189,106 | * | 2/1940 | Garve et al. | 123/69 V |
| 2,381,646 | * | 8/1945 | Carter | 123/69 V |
| 5,133,309 | * | 7/1992 | Ishii | 123/65 V |

* cited by examiner

*Primary Examiner*—Marguerite McMahon
(74) *Attorney, Agent, or Firm*—R. Craig Armstrong

(57) ABSTRACT

The air and exhaust gas management (scavenging) system for a two-cycle internal combustion engine allows the engine to perform comparably to similar four-cycle engines, while remaining lighter, simpler and more cost-effective than its four-cycle counterpart. Scavenging is achieved by locating at least one and preferably a number of air intake valves (1) at the top of the cylinder(s) (2), and at least one and preferably a number of exhaust gas ports (51) in the lower cylinder walls, in combination with a blower (4) which drives scavenging air through the cylinder(s) during the piston downstroke once the exhaust gas ports are uncovered.

15 Claims, 8 Drawing Sheets

AIR AND EXHAUST GAS MANAGEMENT SYSTEM FOR A TWO-CYCLE INTERNAL COMBUSTION ENGINE

This application is a 371 of PCT/CA97/00246 filed Apr. 11, 1997 and also claims benefit of U.S. Provisional Nos. 60/019,481 filed Apr. 12, 1996 and 60/021,981 filed Jul. 18, 1996.

TECHNICAL FIELD

This invention relates to a two-cycle internal combustion engine, and in particular, to an improved combustion air supply and exhaust gas discharge system for same.

BACKGROUND ART

A major problem in the two-cycle engine is the process of purging the exhaust gases and, during the same stroke, providing combustion air. This process of purging the exhaust gases is commonly referred to as "scavenging". Although fuel injection systems mitigate this problem to some extent, proper scavenging is indispensable for achieving high efficiency and low exhaust emissions.

DISCLOSURE OF INVENTION

In view of the above, it is an object of the invention to provide an air supply and exhaust gas management (scavenging) system for two-cycle internal combustion engines, which allows such engines to perform comparably to similar four-cycle engines, while remaining lighter, simpler and more cost-effective than their four-cycle counterparts.

It is a further object of the invention to provide specific features of such a system, including particular system components and component configurations.

In the invention, scavenging is achieved by locating at least one and preferably a number of air intake valves in the head of each cylinder, and at least one and preferably a number of exhaust gas discharge openings in the lower cylinder walls. The air intake valves are controlled solely by air pressure differentials, generated by fluctuating pressure inside the cylinder on one side and in the air supply chamber on the other side. When the piston rim clears the exhaust openings on its dowstroke, pressure in the cylinder decreases below the pressure in the air supply chamber, causing the air intake valves to open and allow scavenging air in. A scavenging blower is used to force air into the air supply chamber and thence through the valves, in order to more effectively purge the exhaust gases form the cylinder as the piston descends. This arrangement can operate in an internal combustion engine utilizing either the Diesel or Otto processes.

The preferred embodiment of the invention is aimed at providing an internal combustion engine with a potential power output of 100 HP to 300 HP, for example, using a modular engine design with, for example, 2, 3, 4, or 6 cylinders with displacements of 1.0 L to 3.0 L, as required. The invention is not limited to specific numbers or sizes of cylinders or specific power outputs, however.

Further features of the invention will be described or will become apparent in the course of the following detailed description.

BRIEF DESCRIPTION OF DRAWINGS

In order that the invention may be more clearly understood, the preferred embodiment thereof will now be described in detail by way of example, with reference to the accompanying drawings, in which.

BEST MODE FOR CARRYING OUT THE INVENTION

Air Supply Side of the Invention

Figure 1:
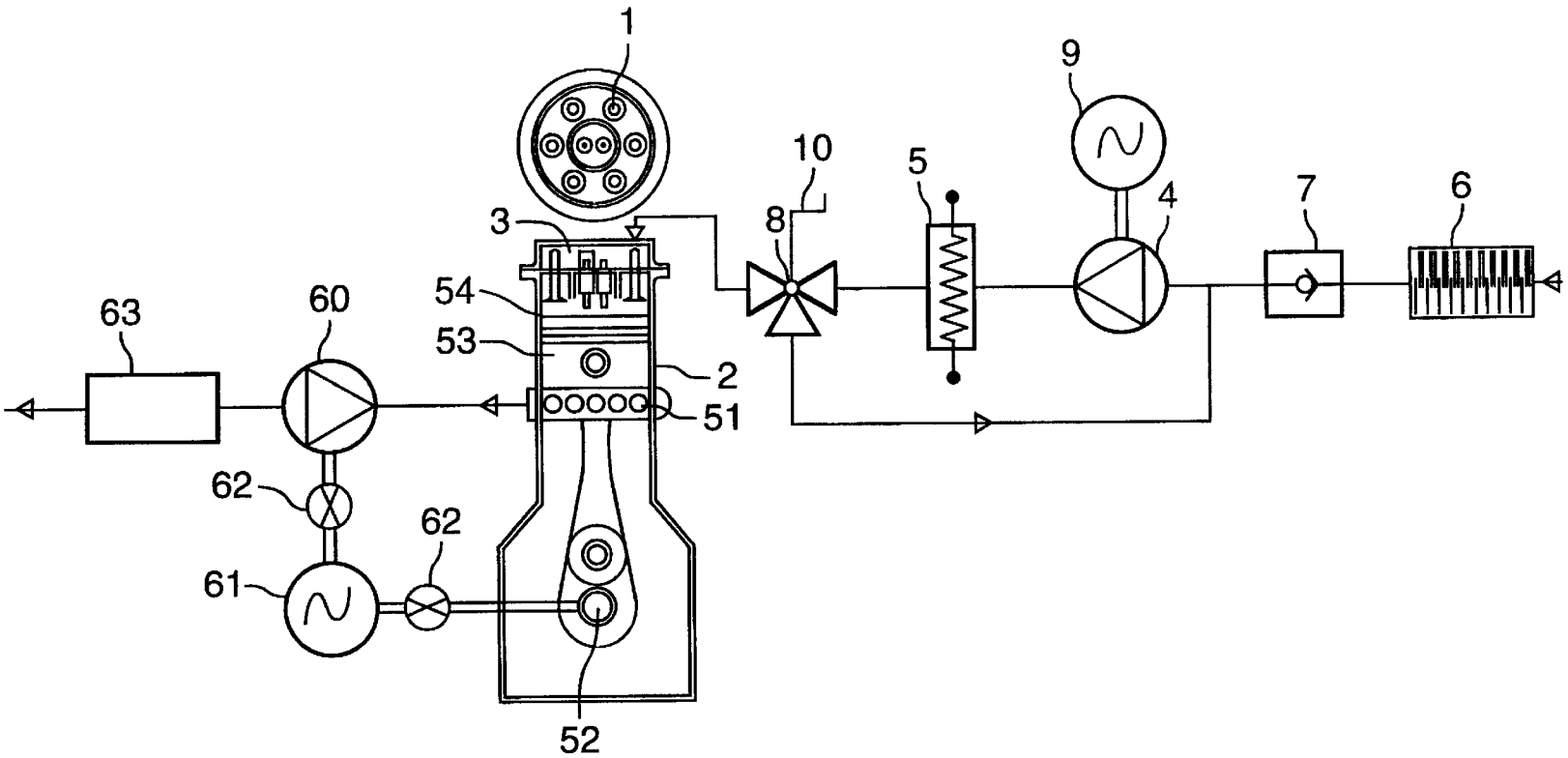
FIG. 1 is a schematic illustration of an embodiment of the invention.

FIG. 1 schematically shows an embodiment of the invention. This embodiment is the currently preferred embodiment, except for the intake valve configuration. The currently preferred intake valve configuration is a shown in FIGS. 2 and 3, or alternatively as shown in FIGS. 7–10. As the development of the engine progresses, other embodiments of the inventive principles may well become preferred to the specific examples described herein.

In the invention, air intake valves 1, described in detail below, provide passageways between each cylinder 2 and an air supply chamber 3. The air intake valves are activated and controlled solely by air pressure differentials created by fluctuating pressure inside the cylinder on one side of the valves, and in the air supply chamber on the other side of the valves.

A key feature of the invention is that a scavenging blower 4 is provided to purge the exhaust gases and, at the same time, to charge the engine with air. Depending on the desired characteristics for the engine, the scavenging blower can be a low pressure type which is just able to overcome the resistances of the air and gas flow channels in order to provide proper scavenging only. Alternatively, a high pressure scavenging blower could be used to provide for pre-compression in the cylinder, for enhanced power output. This high pressure scavenging blower could be coupled with a conventional intercooler 5 to enhance the pre-charging effect.

Because the expansion phase must provide the working stroke in a two-stroke engine, it is desirable to leave the exhaust ports closed for as much of the downstroke as possible. The use of a blower for scavenging improves performance by permitting the opening of the exhaust ports to be delayed without resulting in ineffective scavenging.

The scavenging blower 4 is driven by an electrical servo motor 9 which allows the scavenging blower to immediately respond to changing operating conditions of the engine without being dependent on engine operating conditions such as the revolutions of the crankshaft or the energy content of the exhaust gas. Accordingly, the scavenging blower is driven by the servo motor and is controlled, for example, by a computer program designed to optimize the function of the scavenging blower. The servo motor provides the necessary electronic feedback to the computer program.

As best shown in FIG. 1, the air drawn into the scavenging blower preferably first passes through a conventional air filter 6 and a check valve 7. Before the air reaches the three-way diverter valve 8, described in detail below, the air may, for example, pass through a conventional intercooler 5 if increased power output from the engine is desired.

A three-way diverter valve 8 is located between the intercooler 5 and the air supply chamber 3. Alternatively, if the engine does not include an intercooler, the three-way diverter valve will be located between the outlet of the blower 4 and the air supply chamber. The three-way diverter valve allows more efficient management of the interaction between the scavenging blower and the combustion engine.

The three-way diverter valve is linked to the accelerator 10, such that when the accelerator is depressed and full power is called for, the three-way diverter valve offers unrestricted air flow to the air supply chamber, and when the engine is idling, the air flow is partially directed back to the suction side of the scavenging blower. Alternatively, transducers (not shown) for air pressure and air flow may be incorporated as part of the air supply system to provide feedback to the electronic control system. In an alternative embodiment, the variable position of the three-way diverter valve can be controlled by a second small servo motor (not shown). The control system for this second servo motor receives feedback from an electronic position encoder configured to detect the position of the accelerator.

Figure 2:
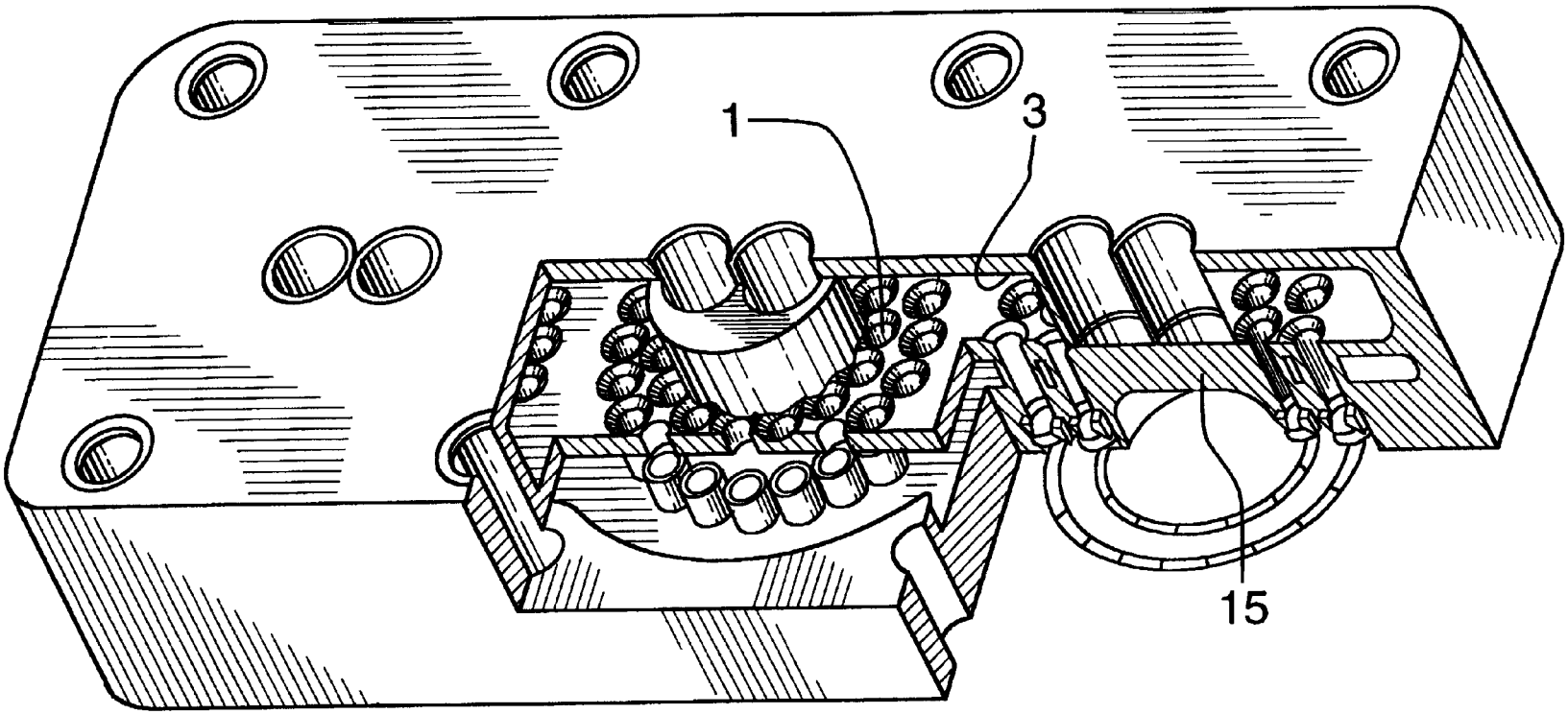
FIG. 2 is a perspective view showing the air supply chamber of the preferred embodiment, with a multitude of air intake valves arranged in concentric circles in the cylinder head.

FIG. 2 shows the air supply chamber 3 with a multitude of identical air intake valves 1 arranged in concentric circles around the top of each cylinder. The air intake valves penetrate the divider wall 15 in the cylinder head between the air supply chamber and the cylinders. As seen best in FIG. 3, the air intake valves encircle the combustion chamber 20 located at the center of each cylinder.

Figure 3:
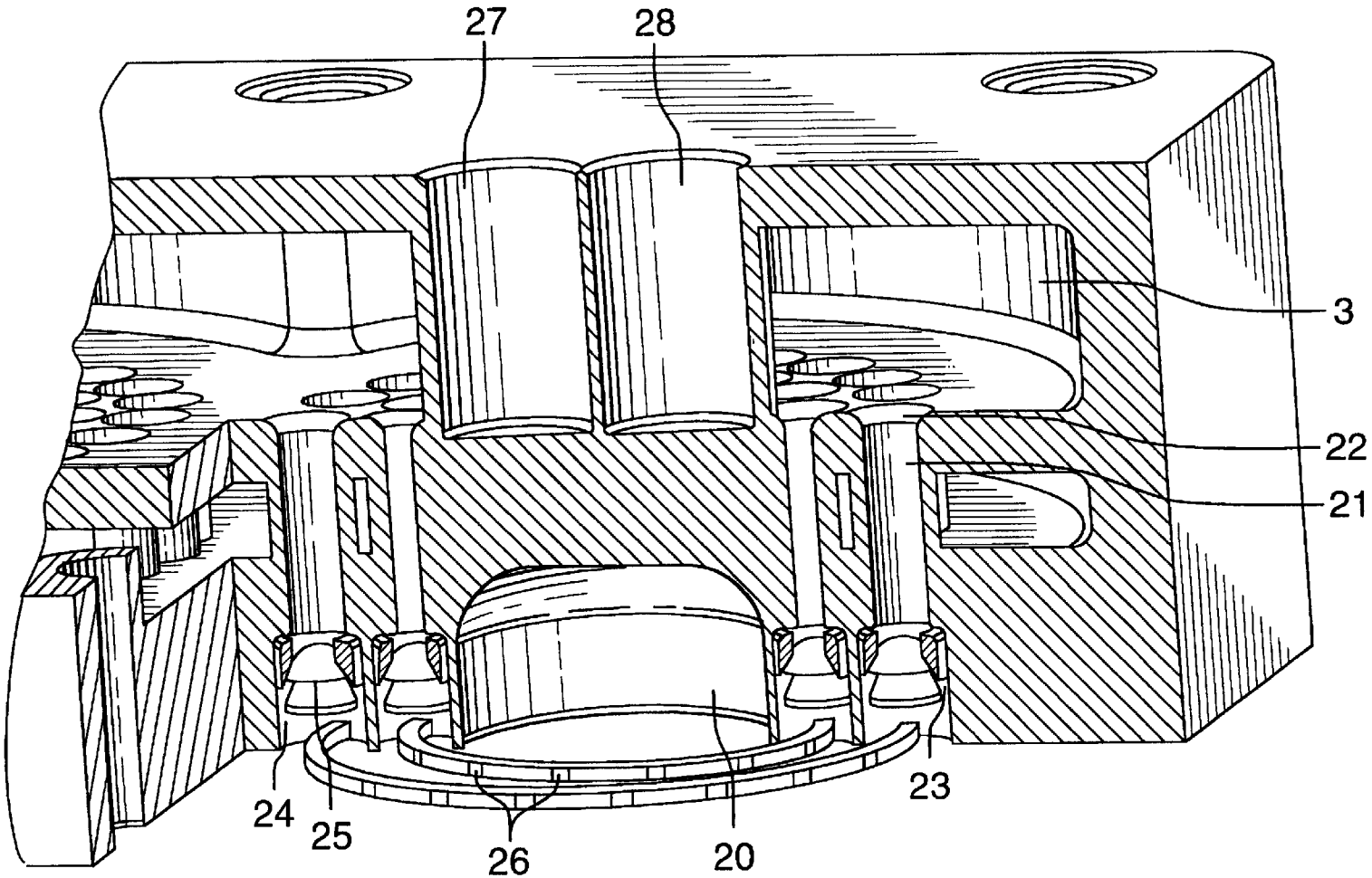
FIG. 3 is a cut-away perspective of the engine block in the area above one of the cylinders.

FIG. 3 also shows that an air intake valve consists of an inlet bore 21 with rounded bore edges 22 and an outlet bore 24. In the preferred embodiment, the inlet bore has a diameter of 7 mm and the outlet bore has a diameter of 11 mm. A ring-shaped seat 23 is located in the outlet bore adjacent to the inlet bore. A check body 25 floats freely in the outlet bore and is retained by the seat ring 23 in the up direction and by concentric retainer rings 26 in the downward direction. The check body is allowed freedom to move axially away from the ring-shaped seat by a sufficient distance to open a channel to permit air flow. In the closed position, the check body abuts against the ring-shaped seat, essentially eliminating air flow. The retainer rings concentric to the cylinder axis have a trapezoidal cross-section, and are fitted within grooves of a complementary trapezoidal shape in the lower plain of the cylinder head. Two bores 27 and 28 penetrate the dividing wall between the air supply chamber and the cylinder to accommodate a spark plug and fuel injection nozzle, respectively.

Figure 4:
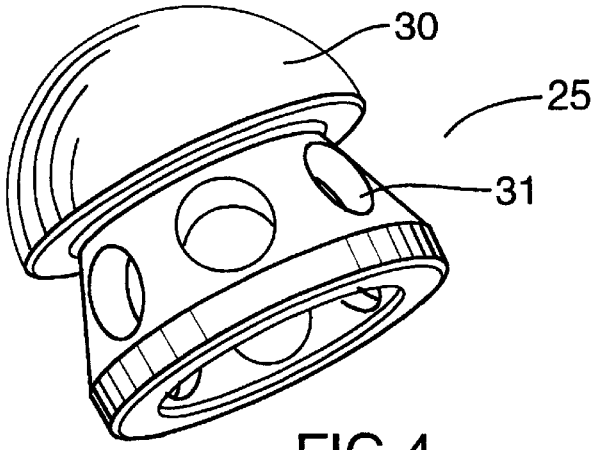
FIG. 4 is a perspective view of one of the check bodies used in the intake valves.

A check body of various shapes may be sued and is preferably manufactured from steel, although other materials, such as ceramic and aluminum alloy materials could be used. To provide maximum operating efficiency, the height of the check body is preferably 8.5 mm and the ratio of the drag coefficients of the face adjacent to the inlet bore versus the face away from the inlet bore is 1:4. As shown in FIG. 4, the most effective shape of the check body is a mushroom shape, with a semi-spherical head 30 facing the inlet bore, attached to a conical stem 31. The conical stem preferably has a number of holes 32 spaced around it, to improve air flow around and through the stem, and to reduce mass and inertia. This check body configuration provides for the 1:4 ratio of drag co-efficient, as mentioned above, and will insure reliable check functioning when the air intake valve is in the 174 closed position.

Figure 5:
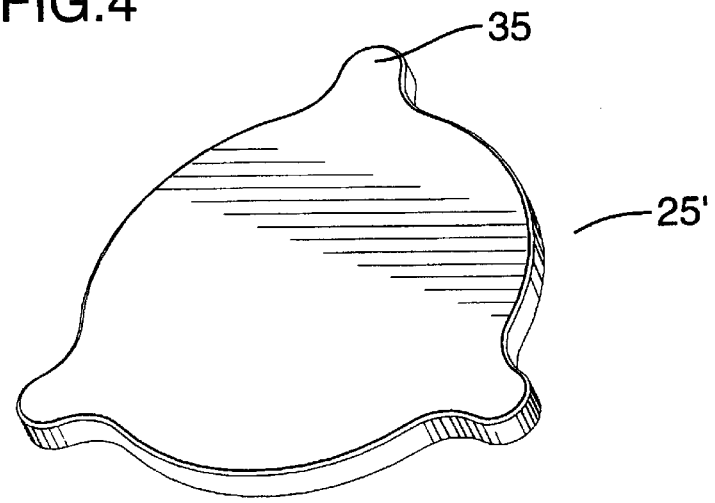
FIG. 5 is a perspective view of an alternative form of check body.
Figure 6:
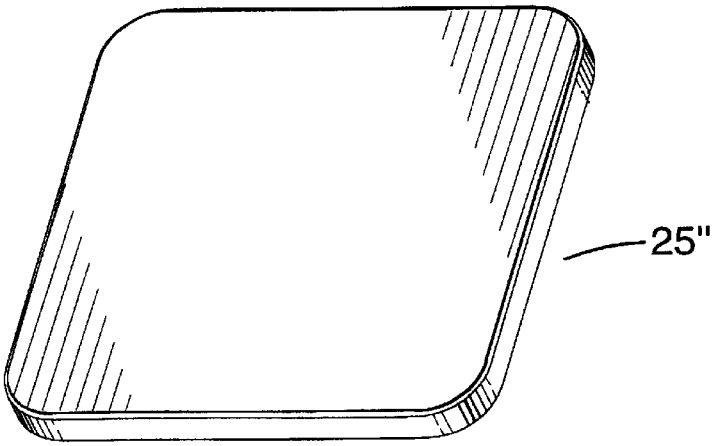
FIG. 6 is a perspective view of another alternative form of check body.

Alternative check body shapes may be used, due to cost considerations or for other reasons. FIG. 5 shows a generally circular disc shape with three rounded bulges 35. These bulges serve as guiding features to keep the disc centered within the valve bore, with sufficient radial play, thereby allowing for the axial motion of the check body in the air flow to perform the function of opening and closing the valve. FIG. 6 shows a check body with the shape of a square disc with rounded corners. Although these shapes do not possess the optimal 1:4 drag coefficient ratio discussed above and are, therefore, less suitable aerodynamically, they have the advantage of being able to be mass produced cheaply. To compensate for their aerodynamic disadvantage, the scavenging blower, described above, may be adjusted to provide a slightly higher air pressure at no significant extra cost.

Figure 7:
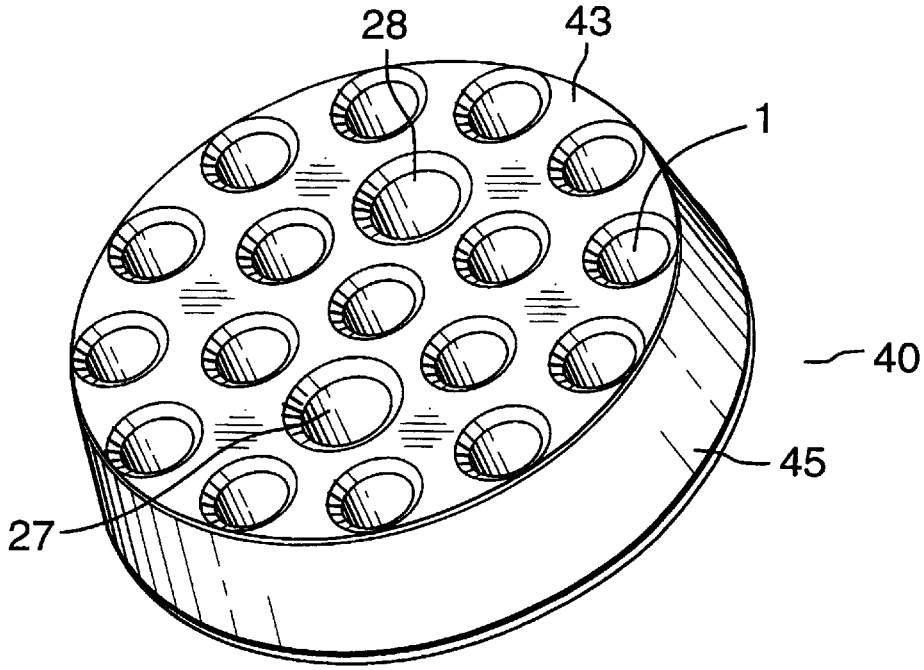
FIG. 7 is a perspective view of an alternative embodiment of the air intake valve assembly, where the valves for each cylinder have been assembled into a single replaceable unit.
Figure 8:
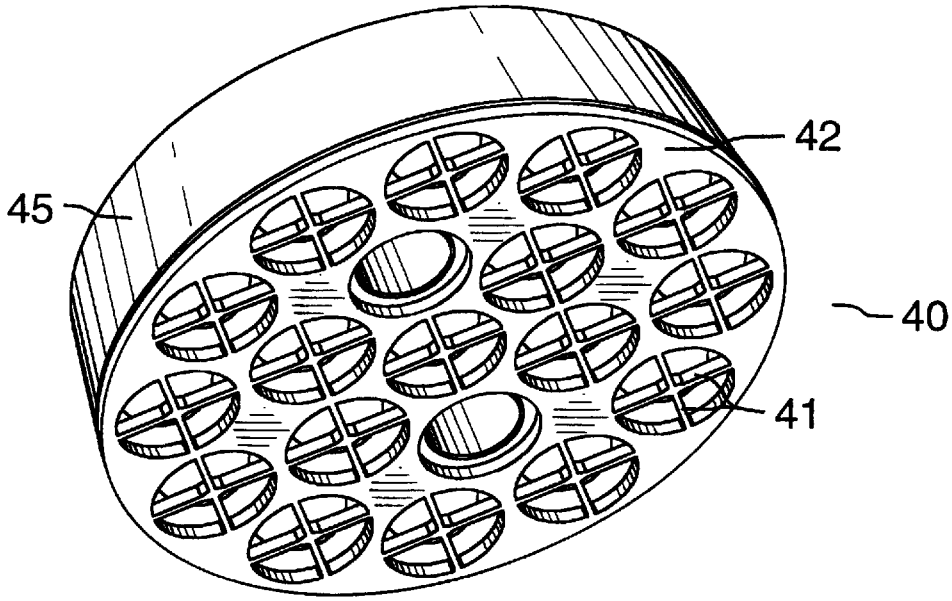
FIG. 8 is a perspective view of the unit of FIG. 7, as seen from the bottom.

FIGS. 7 and 8 show an alternative embodiment of the air intake valve assembly where all of the identical air intake valves for each cylinder have been assembled into a single replaceable unit 40. The replaceable unit has a tapered circumferential wall 45, which joins the larger bottom face 42 to the smaller top face 43. The replaceable unit contains threaded bores 27 and 28 to accommodate the spark or glow plug and the fuel injection nozzle respectively. The check bodies are prevented from falling out in the downward direction by cross members 41, although alternate means of securing the check bodies will be readily apparent to those skilled in the art.

Figure 9:
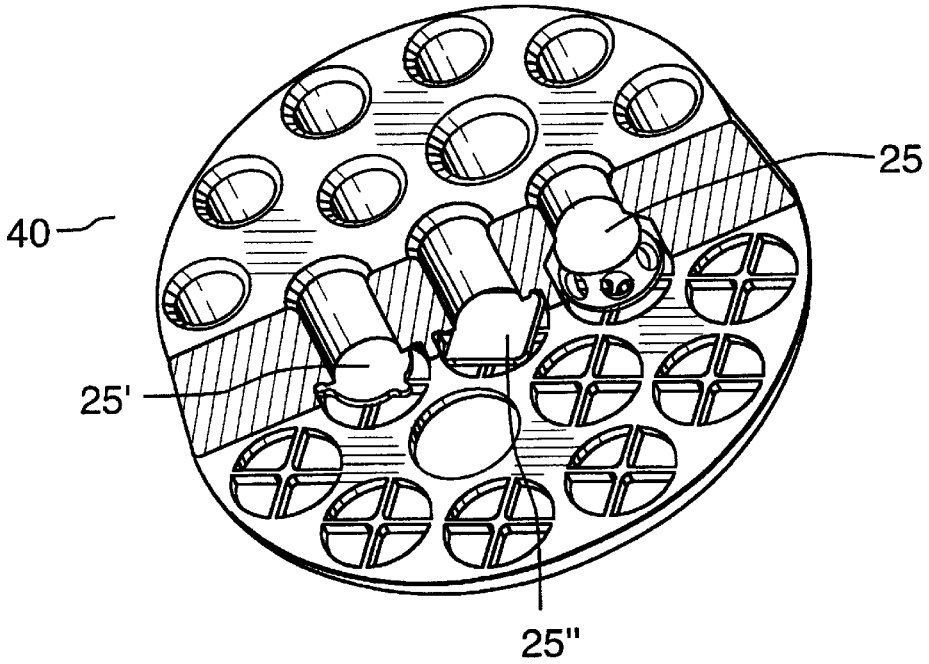
FIG. 9 is a cut-away perspective view illustrating the alternative check body shapes in the replaceable unit.
Figure 10:
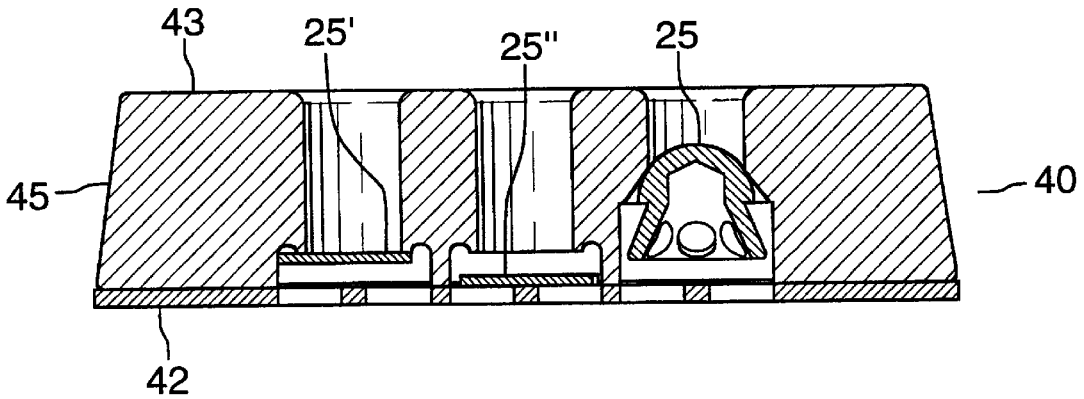
FIG. 10 is a cross-sectional view corresponding to FIG. 9.
Figure 11:
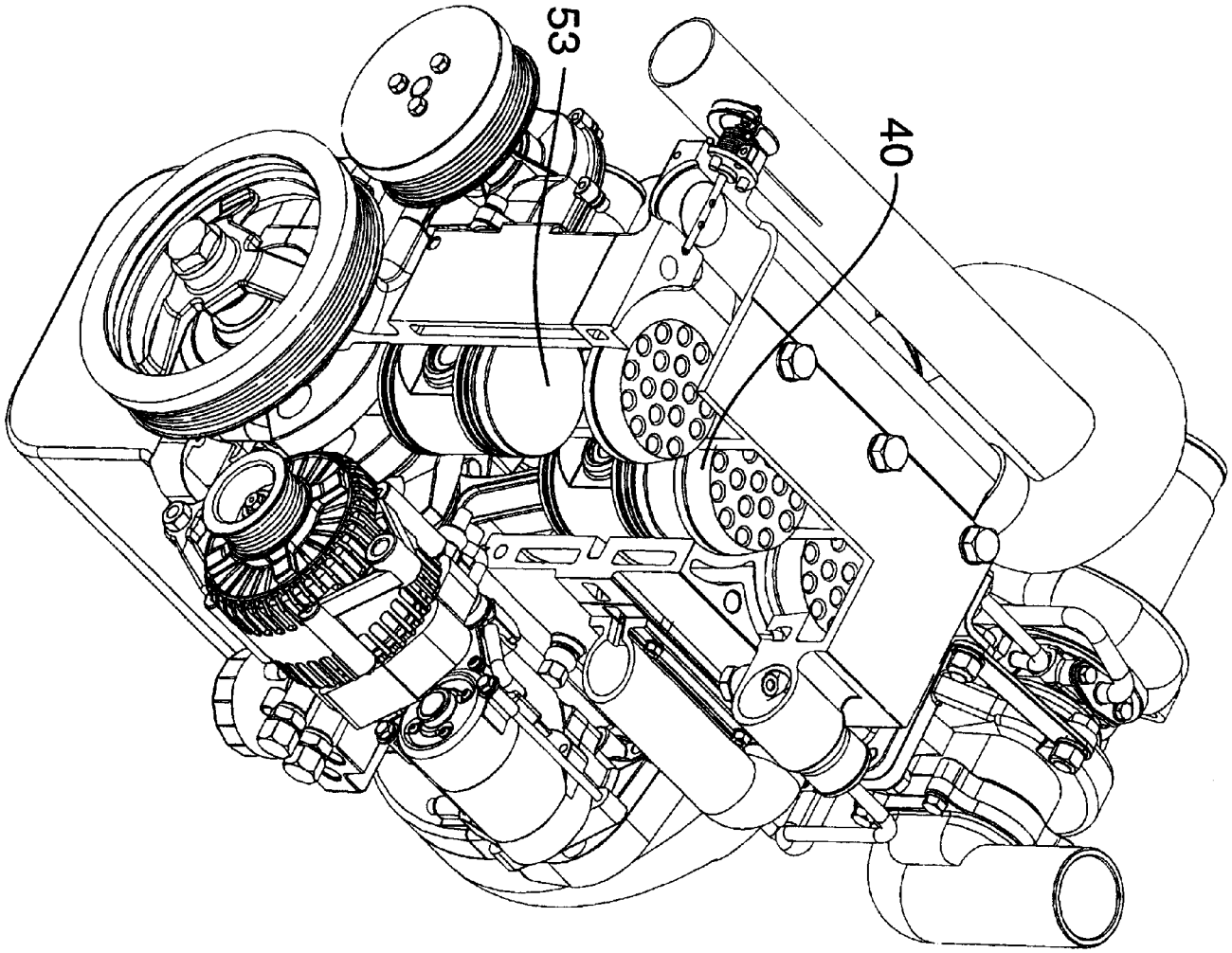
FIG. 11 is a perspective view of a two-cycle engine, according to the invention, fitted with the replaceable valve units.

FIGS. 9 and 10 illustrate the alternative check body shapes which may be used with the replaceable unit. The three different types are shown for purposes of illustration, but in production only one type would normally be used in any one unit. FIG. 11 shows a perspective view of a two-cycle engine, according to the invention, fitted with the replaceable units.

Combining all air intake valves for a cylinder into a single replaceable unit is advantageous because the air intake valves are the only parts of the cylinder head subjected to wear. Thus, integrating the air intake valves into a replaceable unit allows for fast and easy replacement of all of the valves in a cylinder by simply removing the old replaceable unit and replacing it with a new one.

This replaceable unit provides additional advantages. The flattened lower shape of the cylinder head and the flat, cylindrical shape of the combustion chamber upon compression assist in facilitating stratified combustion, which is a prerequisite for low toxicity emissions, particularly when the engine is operating in low load mode.

Furthermore, the replaceable unit facilitates changing the compression ratio for the engine, thereby allowing the invention to easily be incorporated into an Otto or Diesel version of a two-stroke engine.

Exhaust Side of the Invention

In addition to locating the air intake valves in the cylinder head, as described above, exhaust gas openings must be located near the bottom of the cylinder in order to achieve the straight flow scavenging system. As depicted schematically in FIG. 1, exhaust ports 51 are located through the lower cylinder walls near the lowest position of the upper piston rim, when the crankshaft 52 is around the bottom dead center. The exhaust ports preferably are in the shape of radial slots, although that is not specifically illustrated in FIG. 1.

When the upper piston rim clears these exhaust ports on the down-stroke, the pressure in the cylinder will decrease below the pressure in the air supply chamber, causing the air intake valves to open and allow the scavenging air to enter the cylinder. The scavenging air will drive the exhaust gases out of the cylinder via the exhaust ports. Because at least 50% of a cylinder's circumference remains available for scavenging even in an engine with more than one cylinder, the height of the exhaust ports can be quite small so that, unlike a conventional two-cycle engine, little of the crankshaft angle has to be sacrificed to scavenging. This, in turn, contributes to improved overall engine performance.

Since the air intake valves are activated by the air flow, which in turn is controlled by the operating conditions of the scavenging blower and the three-way diverter valve, no exhaust gas recycling valve (EGR) will be necessary in the engine.

Another positive feature of the invention is the fact that the engine lubrication can be accomplished in the same fashion as in four-cycle engines. This offers freedom of choice in designing the bearings of the crankshaft and the piston rods without the restrictions posed by conventional two-cycle engines.

Although a two-stroke engine utilizing the system disclosed herein is lubricated like a conventional four-stroke engine and does not burn oil, there is a possibility of oil droplets being carried away by the exhaust gases. As the piston 53 is clearing the exhaust ports 51 and the scavenging process begins, the thin oil film on the cylinder walls and on the piston rings may generate tiny droplets of oil that accumulate on the rims of the exhaust ports. When these droplets grow to a certain size, they could get torn away by the exiting exhaust gases and enter the catalytic converter.

Figure 12:
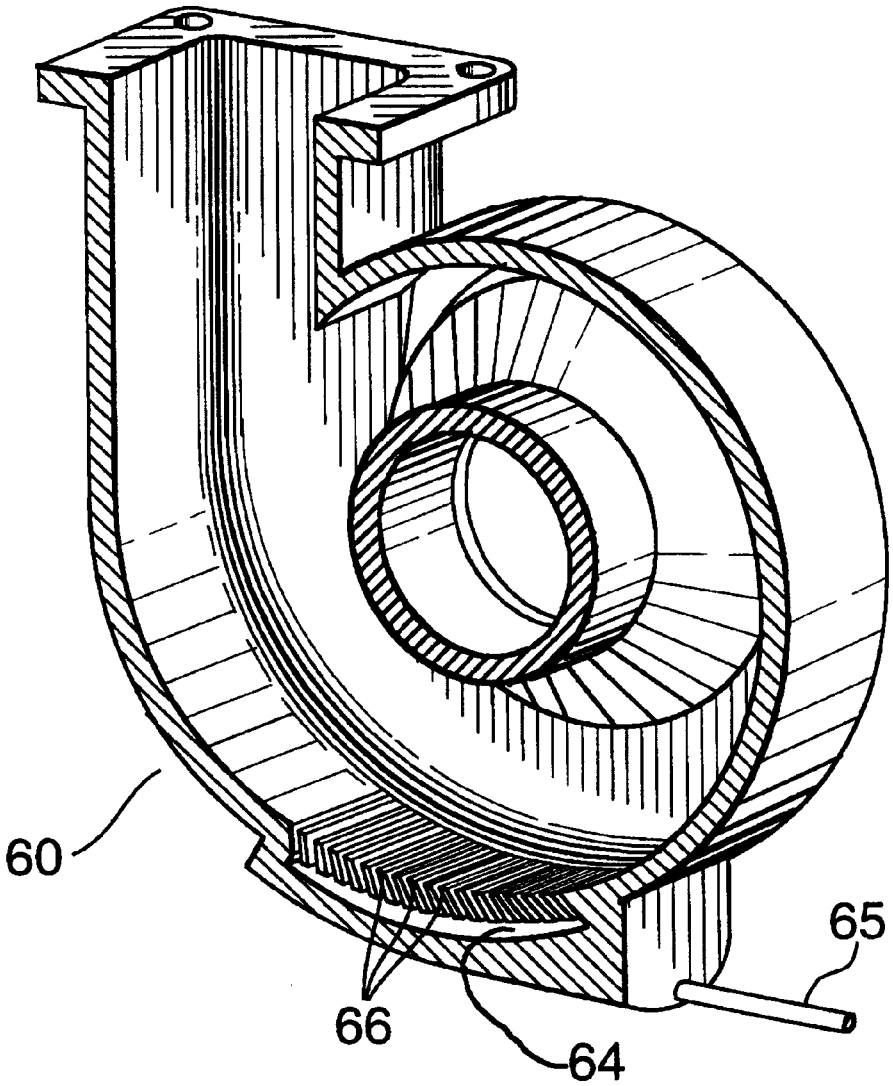
FIG. 12 is a perspective view showing an exhaust gas oil separating apparatus which prevents lubrication oil from remaining in the exhaust gases.

FIG. 12 shows an exhaust gas oil separating apparatus which prevents lubrication oil form remaining in the exhaust gases and adversely affecting the operation of an automobile's catalytic converter. It is comprised of a spiral housing, either as part of an exhaust gas turbine 60 described below, if one is included, or as a separate component. A part of the outside spiral wall of the housing is interrupted by narrow radial gaps 66 leading from the outside spiral wall into a collection chamber 64.

According to the invention, any residual oil in the exhaust gas stream is flung against the outer spiral wall and builds up a film which slowly moves along the spiral wall until it arrives at the radial gaps. The static gas pressure in the spiral housing will drive the oil through the narrow gaps into the abutting collecting chamber 64. A capillary pipe 65 recycles the oil from the collection chamber back to the oil sump (not shown) of the engine.

If the engine is fitted with a conventional turbocharger, the turbine housing will act as the exhaust gas engine oil separator. If the engine is not fitted with a turbocharger, an empty turbine housing without a turbine wheel will be used.

To partially recover the residual energy of the exhaust gases, the preferred embodiment depicted schematically in FIG. 1, provides a conventional expansion turbine 60 attached to the exhaust manifold surrounding the exhaust ports 51. However, in the preferred embodiment, the expansion turbine is not mechanically linked to the blower part, as in conventional turbocharger. As described above, the scavenging blower is driven by an electrical servomotor, making the two parts totally independent and allowing each to operate optimally in any given operating condition. Particularly important is the ability of the scavenging blower to immediately respond the movement of the accelerator, which eliminates the delay of the increased acceleration of the vehicle commonly referred to as "turbo lag". In the preferred embodiment, the expansion turbine is coupled with the alternator, making the conventional battery (not shown) the ultimate energy buffer.

To facilitate the high speed reducing ratio of, preferably, 10:1, the link between the turbine and the alternator 61 will be realized with a multi-micro profile belt drive (not shown), with a small multi-grooved pulley on the shaft of the turbine and a large pulley (also not shown) on the alternator. Accordingly, the expansion turbine and the scavenging blower are only indirectly linked via the battery and can each work within their optimal ranges. Their ability to adapt to changing operating conditions is more spontaneous than in any conventional direct link combination.

The expansion turbine cannot be the only source of power for the alternator because of its inability to supply sufficient energy to the alternator during periods of underload operation. Therefore, according to the invention, the alternator is also lined to the crankshaft, as in a conventional engine, by a second set of pulleys (not shown) and another drive belt (also not shown), with the diameters of the pulleys sized appropriately for the ranges of revolutions of the alternator and crankshaft. The two pulleys located on the alternator shaft each posses and integral freewheeling hub 62, allowing the alternator to be driven by either the expansion turbine or the crankshaft, depending on the load condition under which the engine is operating. Preferably, the alternator will be driven by the exhaust gas turbine when the engine is working at full capacity and maximum power output is required, whereas if the engine is idling, the alternator will be driven by the crankshaft.

In an alternative embodiment, the freewheeling hubs can be replaced by remotely controlled clutches which are, for example, electromagnetically agitated. These clutches would allow finely tuned control of the entire air and exhaust gas management system.

The exhaust gas discharge plant 63 is completed by the addition of a conventional catalytic converter and muffler, including sensors to detect the temperature and chemical composition of the exhaust gases. This feedback to the electronic controls is an essential part of the exhaust gas management system.

It will be appreciated that the above description relates to the preferred embodiment by way of example only. Many variations on the invention will be obvious to those knowledgeable in the field, and such obvious variations are within the scope of the invention as described and claimed, whether or not expressly described herein.

INDUSTRIAL APPLICABILITY

The invention allows a two-cycle engine to arrive at a level of efficiency, fuel economy, and emission quality of a comparable four-cycle engine, but with a smaller, simpler, lighter, and more economical power plant.

What is claimed is:

1. A two-stroke internal combustion engine, having at least one cylinder with a piston mounted therein for reciprocal motion between a top position and a bottom position, wherein each said cylinder has multiple one-way air intake valves above the top of said cylinder and arranged in any pattern within a single replaceable unit, to allow air into the top of said cylinder, and at least one exhaust port at a lower position just above said bottom position of said piston, and a blower arranged to force air into said cylinder via each said intake valve as the piston moves around said bottom position, said blower not supplying enough pressure to keep each said intake valve open during upward motion of said piston, such that during upward motion of said piston, compression occurs within said cylinder, and such that during downward motion of said piston said blower forces air into said cylinder via each said intake valve once each said exhaust port is uncovered by said downward motion, and out of said cylinder via each said exhaust port.

2. A two-stroke internal combustion engine as recited in claim 1, where said air intake valves are controlled solely by air pressure differentials.

3. A two-stroke internal combustion engine as recited in claim 1, where said blower is driven by an electrical servo motor which is controlled by computerized control means to optimize its performance under different engine operating states.

4. A two-stroke internal combustion engine as recited in claim 1, wherein said engine further has a three-way diverter valve located between said blower and said cylinder(s), said diverter valve being linked to an accelerator, such that when the accelerator is depressed and full power is called for, the three-way diverter valve permits unrestricted air flow to said cylinder(s) and when the engine is idling, the air flow is partially directed back to the intake side of the blower.

5. A two-stroke internal combustion engine as recited in claim 4, wherein said engine further has an intercooler connected between said blower and said diverter valve.

6. A two-stroke internal combustion engine as recited in claim 4, where three-way diverter valve is controlled by a servo motor which receives feedback from an electronic position encoder configured to detect the position of the accelerator.

7. A two-stroke internal combustion engine as recited in claim 2, where each said intake valve comprises a check body having a ratio of the drag coefficients of its face adjacent to the inlet bore versus its face away from the inlet bore of approximately 1:4.

8. A two-stroke internal combustion engine as recited in claim 1, wherein said engine further has an expansion turbine connected to receive exhaust from said exhaust port(s) via a passageway, said turbine not being mechanically linked to said blower, said blower and said turbine thus operating independently, whereby the operation of each may be optimized for any given operating condition.

9. A two-stroke internal combustion engine as recited in claim 1, wherein said engine further has an oil-exhaust gas separating means, comprising a spiral housing connected to receive exhaust gas from said exhaust port(s), said spiral housing having a plurality of narrow transverse grooves in at least a portion of a wall of said housing on the outside of the spiral, and a chamber abutting said grooves for receiving oil therefrom.

10. An air-intake valve assembly for use in the head of at least one cylinder in a two-stroke internal combustion engine, wherein said assembly further has:

a multitude of air-intake passageways defined in a body, each of said air-intake passageways having an inlet end communicating with an air supply chamber and an outlet end communicating with a cylinder chamber; and, a plurality of free floating check bodies sandwiched within cavities defined by said outlet ends and retaining means, each of said check bodies positionable between an open and closed position, said positioning controllable via air pressure differentials between said cylinder chamber and said air supply chamber.

11. An air-intake valve assembly as defined in claim 12, where said air pressure differentials are controlled by operating conditions of a scavenging blower and a three-way diverter valve means.

12. An air-intake valve assembly as defined in claim 10, wherein said assembly is formed as a single replaceable unit removably attached to the cylinder head.

13. An air-intake valve assembly as defined in claim 12, wherein said retaining means is a plate mated to a lower end of said body having openings shaped so as to retain said check bodies in said cavities, and wherein said body is further adapted to accommodate a spark or glow plug and a fueled injection nozzle therein.

14. An air-intake valve assembly as defined in claim 13, where each of said check bodies has a ratio of a drag coefficients of its face projecting towards said inlet end versus it face projecting away from said inlet end of approximately 1:4.

15. An air-intake valve assembly as defined in claim 14, where said blower is driven by an electrical servo motor which is controlled by computerized control means to optimize its performance under different engine operating states.

* * * * *

UNITED STATES PATENT AND TRADEMARK OFFICE

CERTIFICATE OF CORRECTION

PATENT NO. : 6,170,444 B1
DATED : January 9, 2001
INVENTOR(S) : Ohlmann, Hans-Armin It is certified that error appears in the above-identified patent and that said Letters Patent is hereby corrected as shown below:

Column 1,
Line 49, more effectively purge the exhaust gases from the cylinder Column 4,
Line 14, air intake valve is in the closed position.
Line 24, possess the optimal 1:4 drag co-efficient ratio discussed Column 5,
Line 46, which prevents lubrication oil from remaining in the exhaust Column 6,
Line 5, in a conventional turbocharger. As described above, the scav-
Line 29, also linked to the crankshaft, as in a conventional engine, by Column 8,
Line 26, 11. An air-intake valve assembly as defined in claim 10, Signed and Sealed this Thirteenth Day of November, 2001

*Attest:*

Nicholas P. Godici

NICHOLAS P. GODICI
*Acting Director of the United States Patent and Trademark Office*

*Attesting Officer*